US011078662B2

(12) United States Patent
Harada et al.

(10) Patent No.: US 11,078,662 B2
(45) Date of Patent: Aug. 3, 2021

(54) STRUCTURE FOR MOUNTING LOUVER PANEL

(71) Applicant: NIPPON STEEL COATED SHEET CORPORATION, Tokyo (JP)

(72) Inventors: Kiyokazu Harada, Hyogo (JP); Yoshio Kayama, Hyogo (JP); Mitsuhiko Yazaki, Tokyo (JP); Tomoyuki Kawazoe, Kanagawa (JP); Atsushi Matsushita, Tokyo (JP); Yuuji Yamano, Tokyo (JP)

(73) Assignee: NIPPON STEEL COATED SHEET CORPORATION, Tokyo (JP)

( * ) Notice: Subject to any disclaimer, the term of this patent is extended or adjusted under 35 U.S.C. 154(b) by 50 days.

(21) Appl. No.: 16/607,359

(22) PCT Filed: Apr. 27, 2018

(86) PCT No.: PCT/JP2018/017250
§ 371 (c)(1),
(2) Date: Oct. 23, 2019

(87) PCT Pub. No.: WO2018/199302
PCT Pub. Date: Nov. 1, 2018

(65) Prior Publication Data

US 2020/0048895 A1 Feb. 13, 2020

(30) Foreign Application Priority Data

Apr. 27, 2017 (JP) ..... JP2017-087974

(51) Int. Cl.
*E04F 10/08* (2006.01)
*E04B 1/41* (2006.01)

(52) U.S. Cl.
CPC ..... *E04B 1/40* (2013.01); *E04F 10/08* (2013.01)

(58) Field of Classification Search
CPC ..... E04F 10/08; E04F 10/10; E04B 1/40
See application file for complete search history.

(56) References Cited

U.S. PATENT DOCUMENTS 10,774,525 B2 * 9/2020 Harada ..... E04B 2/721
2016/0115688 A1 4/2016 Weaver et al.

FOREIGN PATENT DOCUMENTS

CN 1379164 A 11/2002
CN 1925774 A 3/2007
(Continued)

OTHER PUBLICATIONS

International Search Report in PCT/JP2018/017250, dated Jul. 17, 2018. 2pp.

(Continued)

*Primary Examiner* — Adriana Figueroa
(74) *Attorney, Agent, or Firm* — Hauptman Ham, LLP

(57) ABSTRACT

The structure includes a panel and upper and lower mounting units. The panel includes plate members, a rectangular frame spacer, and a core member. Right and left frame parts of the spacer are configured as straight tubular side spacers. Each of the upper and lower mounting units includes: a fixing plate to be fixed onto the upper or lower frame part of a building; mounting members connected inside respective upper or lower end portions of the side spacers such that the mounting members are slidable in an upward/downward direction; and coupling members coupling the mounting members to the fixing plate. Each of the coupling members runs, in a rightward/leftward direction, through an associated one of the mounting members and the fixing plate to couple the associated mounting member rotatably with respect to the fixing plate.

6 Claims, 11 Drawing Sheets

(56) References Cited

FOREIGN PATENT DOCUMENTS

| | | | | | |
|---|---|---|---|---|---|
| CN | 100464053 | C | | 2/2009 | |
| CN | 205936295 | U | | 2/2017 | |
| JP | H538123 | U | | 5/1993 | |
| JP | H10-46723 | A | | 2/1998 | |
| JP | 4783346 | B2 | | 9/2011 | |
| JP | 201540432 | A | | 3/2015 | |
| JP | 2016-169506 | A | | 9/2016 | |
| JP | 2017078294 | A | * | 4/2017 | ..... E04F 10/08 |
| JP | 2017125366 | A | * | 7/2017 | |
| JP | 2017198004 | A | * | 11/2017 | |
| JP | 2018-62747 | A | | 4/2018 | |
| JP | 6725126 | B2 | * | 7/2020 | ..... E04F 10/08 |
| WO | 2005019584 | A2 | | 3/2005 | |

OTHER PUBLICATIONS

Office Action in KR Application No. 10-2019-7031892, dated May 31, 2021. 8pp.

* cited by examiner

STRUCTURE FOR MOUNTING LOUVER PANEL

RELATED APPLICATIONS

The present application is National Phase of International Application Number PCT/JP2018/017250, filed Apr. 27, 2018, and claims priority based on Japanese Patent Application No. 2017-087974, filed Apr. 27, 2017.

TECHNICAL FIELD

The present invention relates to a structure for mounting a louver panel.

BACKGROUND ART

Patent Literature 1 discloses a louver with a sandwich structure in which a metallic spacer unit with a rectangular frame shape is sandwiched between a pair of metallic plate members. The spacer unit includes a pair of straight tubular spacers forming right and left frame parts and another pair of straight tubular spacers forming upper and lower frame parts.

This louver is installed to stand upright between upper and lower plate members of a building. This louver is also installed to be supported by a columnar supporting portion and a pair of rotation regulating members, all of which are provided on the lower plate member.

The louver panel with the sandwich structure disclosed in Patent Literature 1 is possibly bent in the wind, and therefore, needs to be installed to a building with that possibility taken into account.

CITATION LIST

Patent Literature

Patent Literature 1: JP 2016-169506 A

SUMMARY OF INVENTION

It is therefore an object of the present invention to propose a structure for mounting a louver panel while ensuring that the louver panel is mounted with sufficient mounting strength to a building even when bent in the wind.

A louver panel mounting structure according to an aspect of the present invention is a structure for mounting a louver panel. The louver panel is designed to be installed between an upper frame part and a lower frame part of a building. The structure includes: the louver panel; an upper mounting unit configured to mount an upper end portion of the louver panel onto the upper frame part; and a lower mounting unit configured to mount a lower end portion of the louver panel onto the lower frame part. The louver panel includes: a pair of plate members arranged to face each other in a forward/backward direction; a spacer having a shape of a rectangular frame and arranged between the pair of plate members; and a core member arranged in a region between the pair of plate members. The region is surrounded with the spacer. The spacer includes right and left frame parts. The right and left frame parts are configured as a pair of right and left side spacers formed in a straight tubular shape. The upper mounting unit includes: an upper fixing plate to be fixed onto the upper frame part; a pair of upper mounting members connected inside respective upper end portions of the pair of right and left side spacers such that the pair of upper mounting members are slidable in an upward/downward direction; and a pair of upper coupling members coupling the pair of upper mounting members to the upper fixing plate. The lower mounting unit includes: a lower fixing plate to be fixed onto the lower frame part; a pair of lower ounting members connected inside respective lower end portions of the pair of right and left side spacers such that the pair of lower mounting members are slidable in the upward/downward direction; and a pair of lower coupling members coupling the pair of lower mounting members to the lower fixing plate. Each of the pair of upper coupling members runs, in a rightward/leftward direction, through an associated one of the pair of upper mounting members and the upper fixing plate to couple the associated upper mounting member rotatably with respect to the upper fixing plate. Each of the pair of lower coupling members runs, in the rightward/leftward direction, through an associated one of the pair of lower mounting members and the lower fixing plate to couple the associated lower mounting member rotatably with respect to the lower fixing plate.

DESCRIPTION OF EMBODIMENTS

The embodiment to be described below generally relates to a structure for mounting a louver panel, and more particularly relates to a structure for mounting a louver panel with a sandwich structure in which a spacer unit in a rectangular frame shape and a core member are sandwiched between a pair of plate members.

First Embodiment

Figure 1:
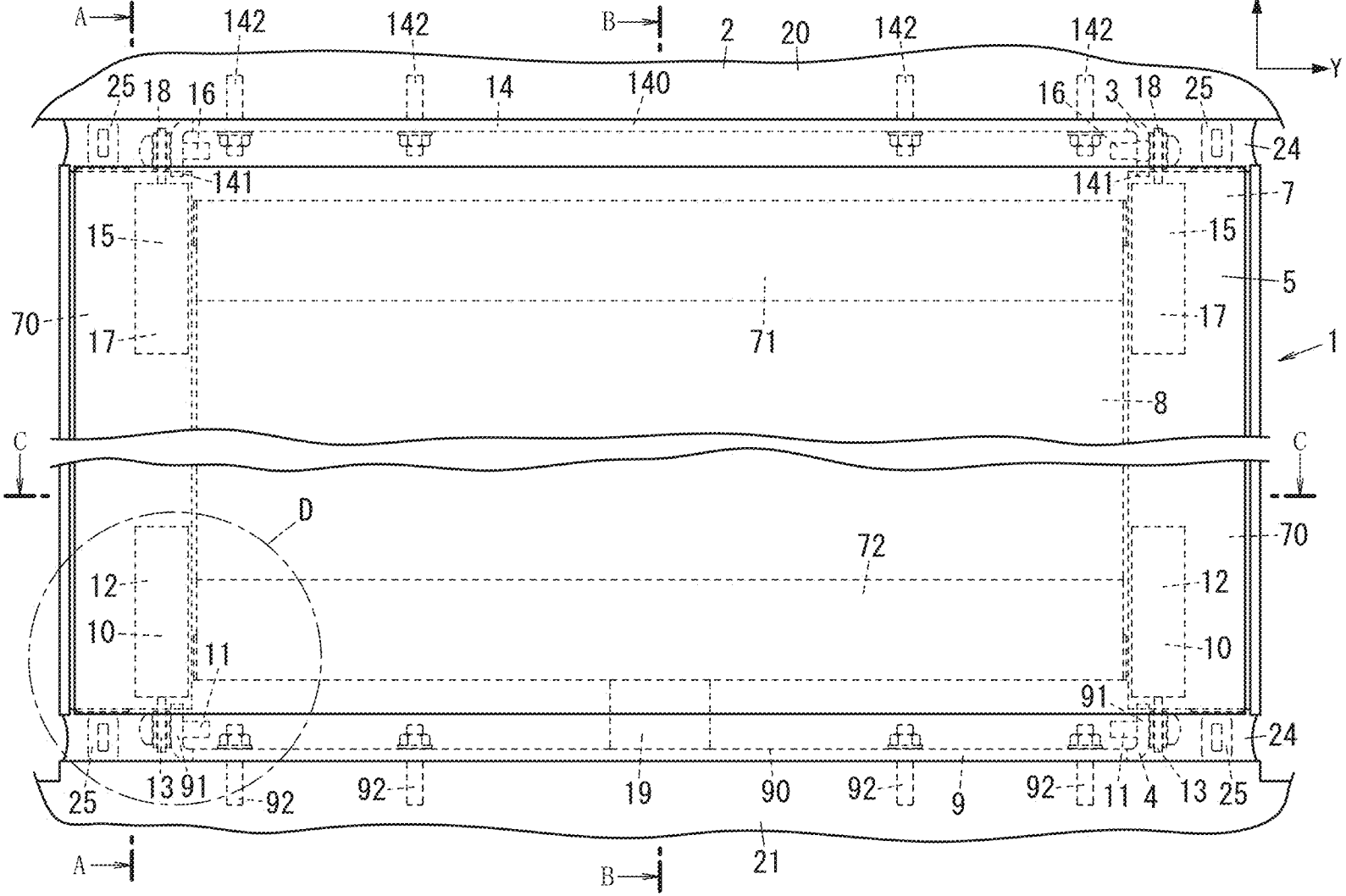
FIG. 1 is a front view illustrating a main part of a structure for mounting a louver panel according to a first embodiment of the present invention.
Figure 2:
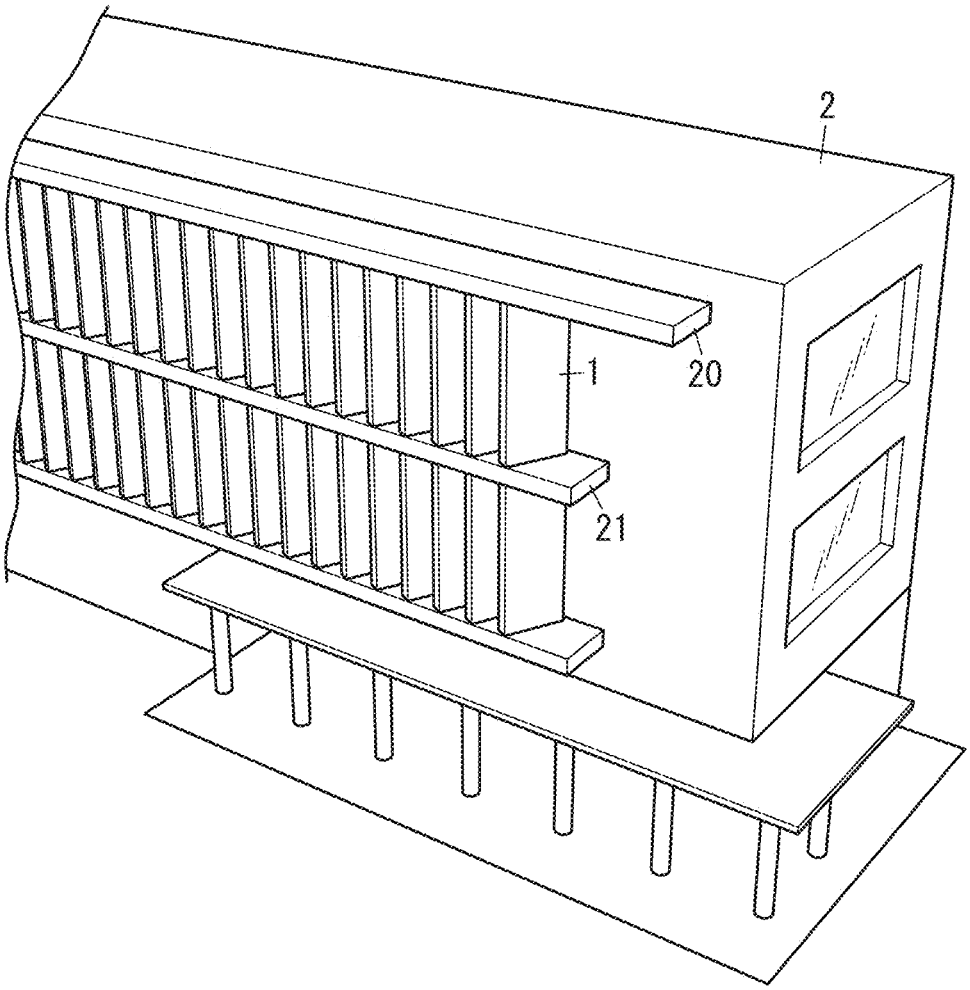
FIG. 2 is a perspective view illustrating an exemplary installation of the louver panel.

FIG. 1 illustrates a structure for mounting a louver panel 1 (hereinafter simply referred to as a "panel 1") according to a first exemplary embodiment of the present invention. As shown in FIG. 2, the panel 1 has the shape of a vertically elongated rectangular plate and is installed to stand upright between an upper frame part 20 and lower frame part 21 of a building 2 such that its own length is parallel to the vertical direction.

In the following description, respective constituent elements of the panel 1 will be described on the supposition that with respect to the panel 1 installed, the thickness of the panel 1 defines the forward/backward direction (as indicated by the arrow X in FIG. 4), the length of the panel 1 defines the upward/downward direction, and the width of the panel 1 defines the rightward/leftward direction. In the drawings, the arrow X indicates the forward direction, the arrow Y indicates the rightward direction, and the arrow Z indicates the upward direction.

As shown in FIG. 1, the structure for mounting the panel 1 (in other words, a louver panel system) includes the panel 1, an upper mounting unit 3 for mounting an upper end portion of the panel 1 onto the upper frame part 20 of the building 2, and a lower mounting unit 4 for mounting a lower end portion of the panel 1 onto the lower frame part 21 of the building 2.

First of all, the panel 1 will be described.

The panel 1 includes a pair of plate members 5 and 6 arranged to face each other in the forward/backward direction, a spacer 7 in a rectangular frame shape, and a core member 8 as shown in FIGS. 1, 3A, 3B, and 4. The spacer 7 is arranged between the pair of plate members 5 and 6. The core member 8 is disposed over the entire region surrounded with the pair of plate members 5 and 6 and the spacer 7.

The plate member 5, constituting the front surface of the panel 1, includes: a front surface portion 50 formed in the shape of a rectangular plate and arranged in front of the spacer 7 and the core member 8; a pair of side surface portions 51 respectively arranged on the right and left of the spacer 7; an upper surface portion 52 arranged over the spacer 7; and a lower surface portion 53 arranged under the spacer 7.

The pair of side surface portions 51 respectively protrude backward from the right and left edges of the front surface portion 50. The upper surface portion 52 protrudes backward from the top edge of the front surface portion 50. The lower surface portion 53 protrudes backward from the bottom edge of the front surface portion 50. The pair of side surface portions 51, the upper surface portion 52, and the lower surface portion 53 are all generally perpendicular to the front surface portion 50. The pair of side surface portions 51 are respectively provided for the right and left edges of the front surface portion 50 over the entire length thereof in the upward/downward direction. The upper surface portion 52 is provided for the upper edge of the front surface portion 50 over the entire length thereof in the rightward/leftward direction. The lower surface portion 53 is provided for the lower edge of the front surface portion 50 over the entire length thereof in the rightward/leftward direction.

The plate member 6, constituting the rear surface of the panel 1, includes: a rear surface portion 60 formed in the shape of a rectangular plate and arranged behind the spacer 7 and the core member 8; a pair of side surface portions 61 respectively arranged on the right and left of the spacer 7; an upper surface portion 62 arranged over the spacer 7; and a lower surface portion 63 arranged under the spacer 7.

The pair of side surface portions 61 respectively protrude forward from the right and left edges of the rear surface portion 60. The upper surface portion 62 protrudes forward from the top edge of the rear surface portion 60. The lower surface portion 63 protrudes forward from the bottom edge of the rear surface portion 60. The pair of side surface portions 61, the upper surface portion 62, and the lower surface portion 63 are all generally perpendicular to the rear surface portion 60. The pair of side surface portions 61 are respectively provided for the right and left edges of the rear surface portion 60 over the entire length thereof in the upward/downward direction. The upper surface portion 62 is provided for the upper edge of the rear surface portion 60 over the entire length thereof in the rightward/leftward direction. The lower surface portion 63 is provided for the lower edge of the rear surface portion 60 over the entire length thereof in the rightward/leftward direction.

The plate members 5 and 6 are each formed by folding a metal plate. Examples of the metal plates include a painted steel plate, a zinc plated steel plate, a Galvalume steel plate®, SGL® steel plate, a stainless steel plate, an aluminum steel plate, and a titanium plate. Note that these are only examples and should not be construed as limiting. The metal plate may have a thickness of 0.35 mm to 1.2 mm, for example.

The spacer 7 includes: a pair of straight tubular, right and left side spacers 70 forming right and left frame parts of the spacer 7; a straight tubular upper spacer 71 forming an upper frame part of the spacer 7; and a straight tubular lower spacer 72 forming a lower frame part of the spacer 7.

The pair of right and left side spacers 70 each have the same longitudinal dimension (i.e., the dimension measured in the upward/downward direction). The upper and lower spacers 71 and 72 each have the same lateral dimension (i.e., the dimension measured in the rightward/leftward direction). The longitudinal dimension (i.e., the dimension measured in the upward/downward direction) of the pair of right and left side spacers 70 is greater than the longitudinal dimension (i.e., the dimension measured in the rightward/leftward direction) of the upper and lower spacers 71 and 72. The pair of right and left side spacers 70 and the upper and lower spacers 71 and 72 all have the same thickness (i.e., the same dimension measured in the forward/backward direction).

Figure 4:
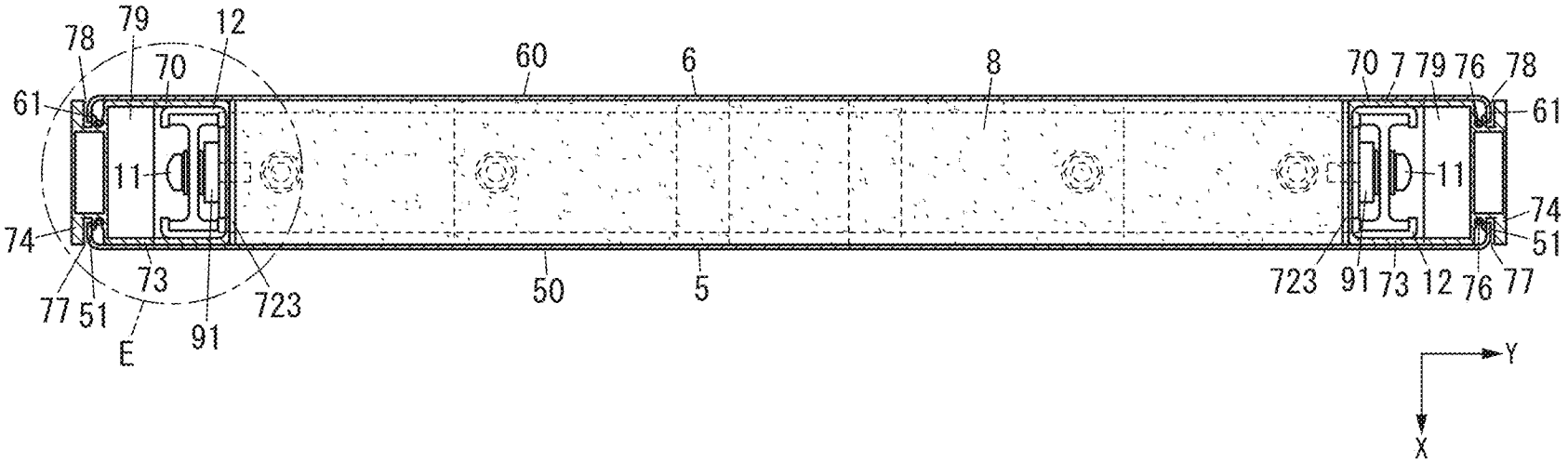
FIG. 4 is a cross-sectional view thereof taken along the plane C-C shown in FIG. 1.

As shown in FIG. 4, the pair of right and left side spacers 70 each include a spacer body 73 having a rectangular frame shape in a plane cross-sectional view, and a decorative cover 74 arranged on the right or left outside of the spacer body 73. Specifically, in the side spacer 70 on the right, the decorative cover 74 is arranged on the right of the spacer body 73. In the side spacer 70 on the left, the decorative cover 74 is arranged on the left of the spacer body 73. Each of the pair of right and left side spacers 70 is an extruded product of aluminum including the spacer body 73 and the decorative cover 74, which are formed integrally with each other. Each of the pair of right and left side spacers 70 has a consistent cross-sectional shape over the entire length thereof in the upward/downward direction. The right side spacer 70 and the left side spacer 70 have symmetric shapes in the rightward/leftward direction. The left side spacer 70 will be described in the following description.

Figure 5B:
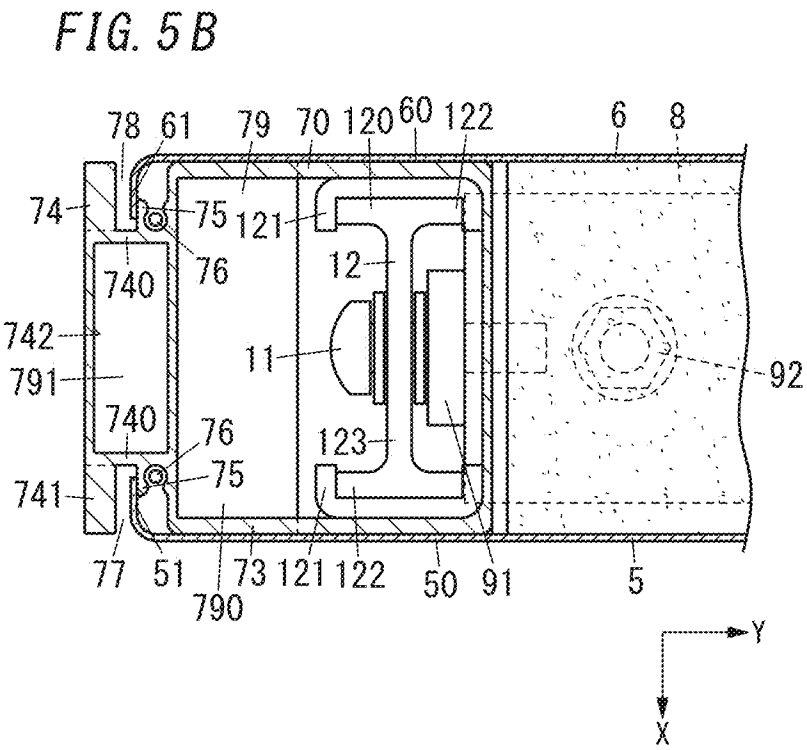
FIG. 5B is an enlarged view of portion E in FIG. 4.

As shown in FIG. 5B, the decorative cover 74 includes a pair of protruding pieces 740 protruding to the left from respective parts, closer to the front and rear ends, of the left frame portion of the spacer body 73 and a cover body 741 formed in the shape of a rectangular plate integrally with the respective tips (left ends) of the pair of protruding pieces 740. The dimension measured in the forward/backward direction of the cover body 741 is approximately equal to the dimension measured in the forward/backward direction of the spacer body 73. The cover body 741 is arranged with a gap left with respect to the spacer body 73.

One surface, facing the spacer body 73 (i.e., the right surface), of the cover body 741 has a recess 742 in a central region thereof in the forward/backward direction. The region surrounded with the cover body 741, the pair of protruding pieces 740, and the spacer body 73 has a rectangular shape in a plane cross-sectional view, and is separated from the inner region of the spacer body 73.

The side spacer 70 further includes: a receiving piece 75 extended forward from the middle in the rightward/leftward direction of the front protruding piece 740; and another receiving piece 75 extended forward from the middle in the rightward/leftward direction of the rear protruding piece 740. An insertion hole 76 to which a fastening member such as a screw may be inserted and fixed is formed between the front receiving piece 75 and the spacer body 73. Likewise, another insertion hole 76 to which a fastening member such as a screw may be inserted and fixed is formed between the rear receiving piece 75 and the spacer body 73.

The side spacer 70 further has a front groove 77 formed between the front receiving piece 75 and the cover body 741 and opening forward, and a rear groove 78 formed between the rear receiving piece 75 and the cover body 741 and opening backward.

The panel 1 further includes cover members 79 attached to the upper and lower ends of the pair of side spacers 70. The panel 1 includes four cover members 79. All of these four cover members 79 have the same dimensions and the same shape.

Each cover member 79 includes an inner cover portion 790, of which the dimension in the forward/backward direction is as large as that of the spacer body 73; and an outer cover portion 791, of which the dimension in the forward/backward direction is equal to the gap distance between the pair of protruding pieces 740. The inner cover portion 790 of each cover member 79 covers the range from the pair of receiving pieces 75 through the middle in the rightward/leftward direction of the spacer body 73. On the other hand, the outer cover portion 791 covers the range from the pair of receiving pieces 75 through the cover body 741. Each cover member 79 is attached to the upper or lower end of an associated one of the pair of side spacers 70 with fastening members such as screws driven into the front and rear insertion holes 76.

Next, the upper spacer 71 and the lower spacer 72 will be described.

The upper spacer 71 has the structure obtained by rotating the lower spacer 72 180 degrees on a vertical plane. In the following description, the lower spacer 72 will be described in detail.

Figure 3A:
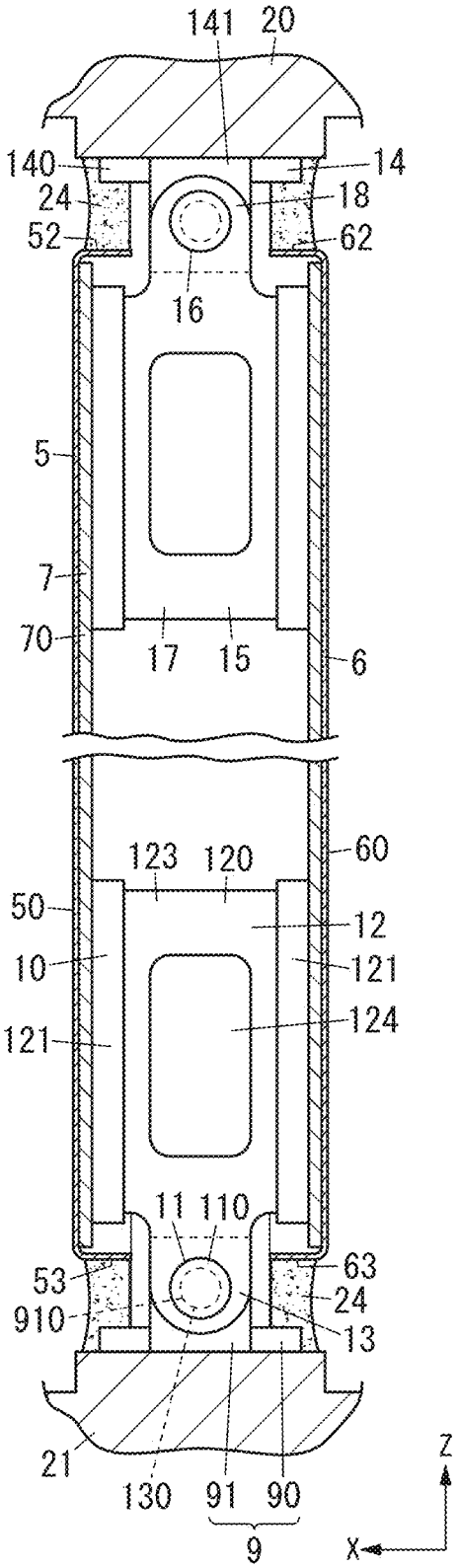
FIG. 3A is a cross-sectional view thereof taken along the plane A-A shown in FIG. 1.
Figure 3B:
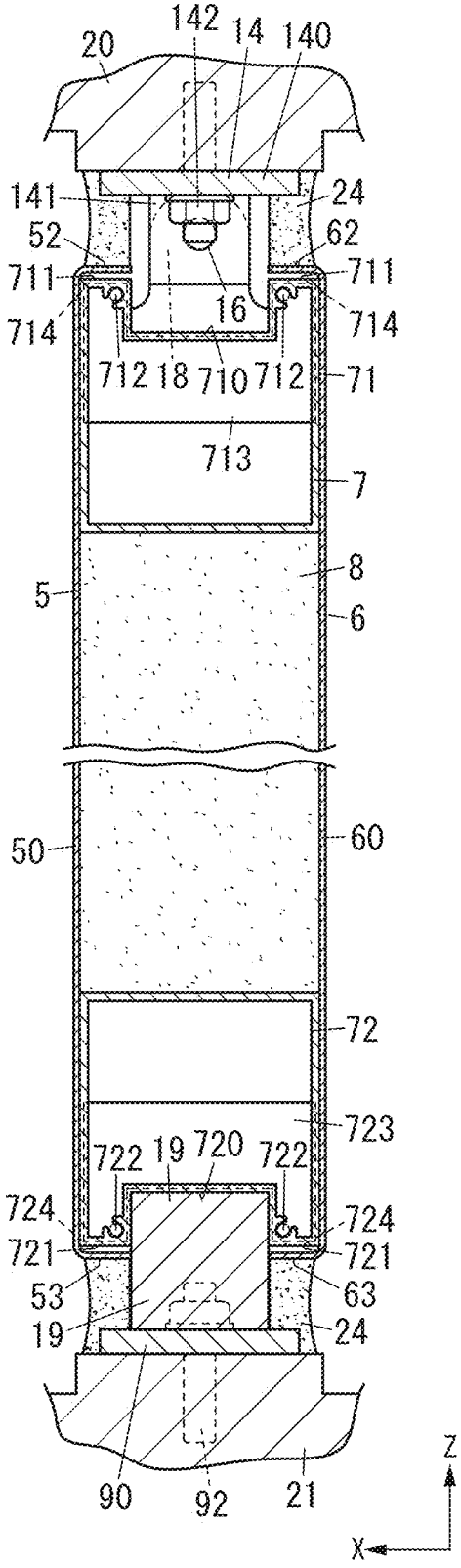
FIG. 3B is a cross-sectional view thereof taken along the plane B-B shown in FIG. 1.

As shown in FIG. 3B, the lower spacer 72 has, on the lower surface thereof, a recess 720 opening downward. The recess 720 is provided for the lower surface of the lower spacer 72 over the entire length thereof in the rightward/leftward direction. The lower spacer 72 has a consistent cross-sectional shape over the entire length thereof. The lower spacer 72 is an extruded product of aluminum.

The recess 720 is located in the middle in the forward/backward direction of the lower surface of the lower spacer 72. The lower spacer 72 has a pair of flat portions 721 which are respectively located forward and backward of the recess 720 on the lower surface thereof. The lower surface portion 53 of the plate member 5 is arranged to cover the front flat portion 721. The lower surface portion 63 of the plate member 6 is arranged to cover the rear flat portion 721. The recess 720 is covered with neither the lower surface portion 53 nor the lower surface portion 63.

The lower spacer 72 further has two insertion holes 722 inside a corner portion formed by the front flat portion 721 and the recess 720 and a corner portion formed by the rear flat portion 721 and the recess 720, respectively. A fastening member such as a screw may be inserted and fixed into each of the insertion holes 722.

The panel 1 further includes two closing plates 723, which are respectively attached to the right and left end faces of the lower spacer 72. Each closing plate 723 is attached to the lower spacer 72 with fastening members such as screws to be inserted and fixed into associated insertion holes 722. Each closing plate 723 is interposed between the lower spacer 72 and an associated one of the right and left side spacers 70.

Each closing plate 723 is a generally U-shaped plate member with a downward opening. Each closing plate 723 is attached to the lower spacer 72 so as to close the entire lower half, but the recess 720, of the opening at either right or left end face of the lower spacer 72.

Each closing plate 723 is a plate member made of aluminum or a plate member covered with an elastic member such as a butyl tape, for example. Each closing plate 723 is attached so as to be located somewhat over the lower surface (flat portion 721) of the lower spacer 72. The gap under each closing plate 723 is filled with a sealant 724. Closing the gap between the lower spacer 72 and the right or left side spacer 70 with each closing plate 723 and the sealant 724 reduces the chances of rain water permeating through the gap into the core member 8.

The upper spacer 71 includes a recess 710, a pair of front and rear flat portions 711, and a pair of front and rear insertion holes 712, respectively corresponding to the recess 720, pair of front and rear flat portions 721, and pair of front and rear insertion holes 722 of the lower spacer 72.

The upper surface portion 52 of the plate member 5 is arranged to cover the front flat portion 711. The upper surface portion 62 of the plate member 6 is arranged to cover the rear flat portion 711. The recess 710 is covered with neither the lower surface portion 53 nor the lower surface portion 63.

The panel 1 further includes two closing plates 713, which are respectively attached to the right and left end faces of the upper spacer 71. Each closing plate 713 is attached to the upper spacer 71 with fastening members such as screws to be inserted and fixed into associated insertion holes 712. Each closing plate 713 is interposed between the upper spacer 71 and an associated one of the right and left side spacers 70. The closing plates 713 are the same type of plates as the closing plates 723.

Each closing plate 723 is attached so as to be located somewhat under the upper surface (flat portion 711) of the upper spacer 71. The gap over each closing plate 713 is filled with a sealant 714. Closing the gap between the upper spacer 71 and the right or left side spacer 70 with each closing plate 713 and the sealant 714 reduces the chances of rain water permeating through the gap into the core member 8.

The upper spacer 71 is arranged to be interposed between the respective upper end portions of the pair of side spacers 70. The lower spacer 72 is arranged to be interposed between the respective lower end portions of the pair of side spacers 70.

The core member 8 is made up of a plurality of block members, which are arranged side by side in the rightward/leftward direction such that the block members form a single plate as a whole. Each of these block members may be formed by binding, with a binder, for example, some fibrous inorganic material such as rock wool or glass wool. The core member 8 is arranged in the entire region surrounded with the spacer 7. Alternatively, the core member 8 may also be some resin foam (such as urethane foam, phenol foam, or styrene foam) filling the entire region surrounded with the spacer 7.

The spacer 7 and the core member 8 are secured with adhesive onto the entire front surface portion 50 of the plate member 5 and the entire rear surface portion 60 of the plate member 6. The right and left side surface portions 51 of the plate member 5 are respectively received in the front grooves 77 of the pair of side spacers 70. The right and left side surface portions 61 of the plate member 6 are respectively received in the rear grooves 78 of the pair of side spacers 70.

The upper surface portion 52 of the plate member 5 covers the front half of the upper surface of the cover members 79 attached to the respective upper ends of the pair of side spacers 70 and the upper surface of the front flat portion 711 of the upper spacer 71. The lower surface portion 53 of the plate member 5 covers the front half of the lower surface of the cover members 79 attached to the respective lower ends of the pair of side spacers 70 and the lower surface of the front flat portion 721 of the lower spacer 72.

The upper surface portion 62 of the plate member 6 covers the rear half of the upper surface of the cover members 79 attached to the respective upper ends of the pair of side spacers 70 and the upper surface of the rear flat portion 711 of the upper spacer 71. The lower surface portion 63 of the plate member 6 covers the rear half of the lower surface of the cover members 79 attached to the respective lower ends of the pair of side spacers 70 and the lower surface of the rear flat portion 721 of the lower spacer 72.

Next, the lower mounting unit 4 will be described.

As shown in FIG. 1, the lower mounting unit 4 includes: a lower fixing plate 9 to be fixed onto the lower frame part 21; a pair of lower mounting members 10 connected inside respective lower end portions of the pair of right and left side spacers 70 such that the pair of lower mounting members 10 are slidable in an upward/downward direction; and a pair of lower coupling members 11 coupling the pair of lower mounting members 10 to the lower fixing plate 9. Each of the pair of lower coupling members 11 runs, in the rightward/leftward direction, through an associated one of the pair of lower mounting members 10 and the lower fixing plate 9 to couple the associated lower mounting member 10 rotatably with respect to the lower fixing plate 9.

As shown in FIGS. 1 and 3A, the lower fixing plate 9 includes a body 90 in a rectangular plate shape and a pair of lower protrusions 91 respectively extended upward from the right and left ends of the body 90. The dimension in the rightward/leftward direction of the body 90 is approximately equal to the dimension in the rightward/leftward direction of the lower spacer 72. The body 90 will be secured with fastening members 92 such as anchoring bolts onto the lower frame part 21.

Each lower protrusion 91 is extended upward from the middle in the forward/backward direction of the right or left end portion of the body 90, and has a shorter dimension in the forward/backward direction than the body 90. The dimension in the forward/backward direction of the lower protrusion 91 is less than the interval between the lower surface portions 53 and 63. In this embodiment, the lower protrusion 91 is configured as a single piece of a rectangular plate. The lower fixing plate 9 is formed by folding a steel plate, for example. Each of the pair of right and left lower protrusions 91 has a through hole 910 running through the lower protrusion 91 in the rightward/leftward direction.

The pair of lower mounting members 10 have the same shape and the same dimensions. The left one of these two lower mounting members 10 will be described first in the following description.

Figure 5A:
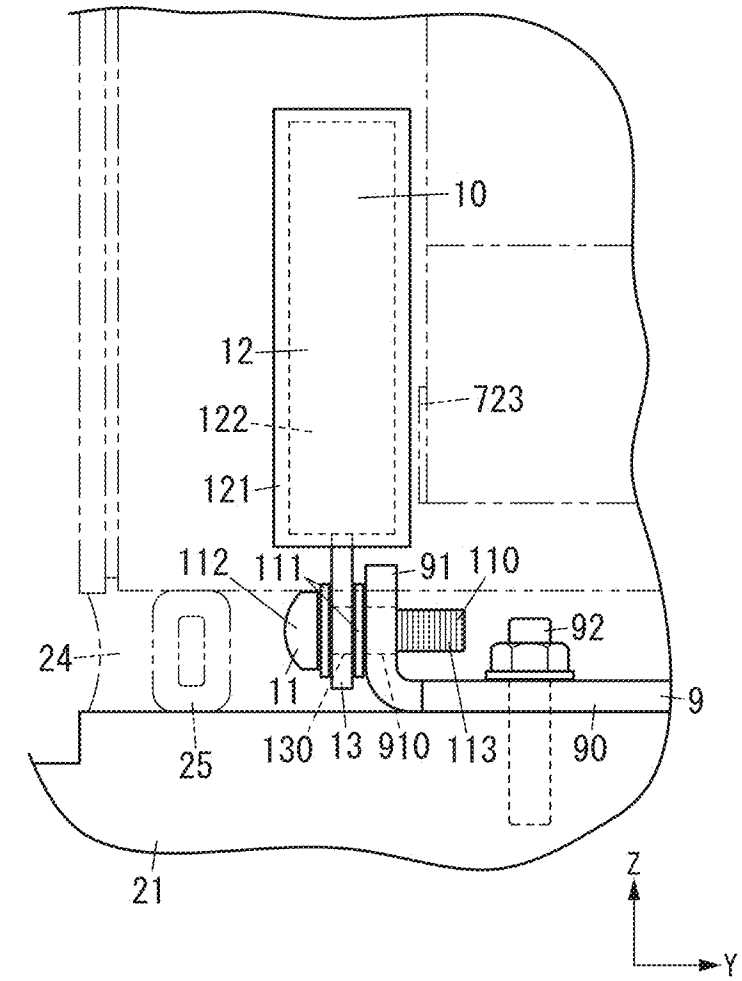
FIG. 5A is an enlarged view of portion D in FIG. 1, wherein the louver panel, a sealing member, and a backup member are indicated in phantom.

As shown in FIGS. 5A and 5B, the lower mounting member 10 includes a lower fitting portion 12 to be fitted into a lower end portion of the left side spacer 70 and a lower coupling piece 13 extended downward from the lower fitting portion 12. The lower coupling piece 13 has a smaller dimension in the forward/backward direction than the lower fitting portion 12.

Figure 6A:
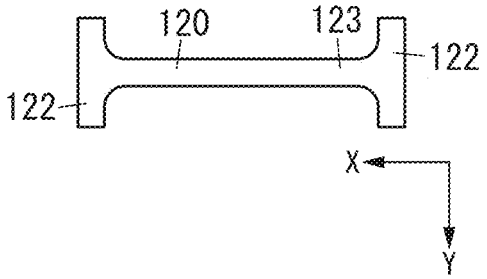
FIG. 6A is a plan view illustrating a mounting member for the structure for mounting the louver panel.
Figure 6B:
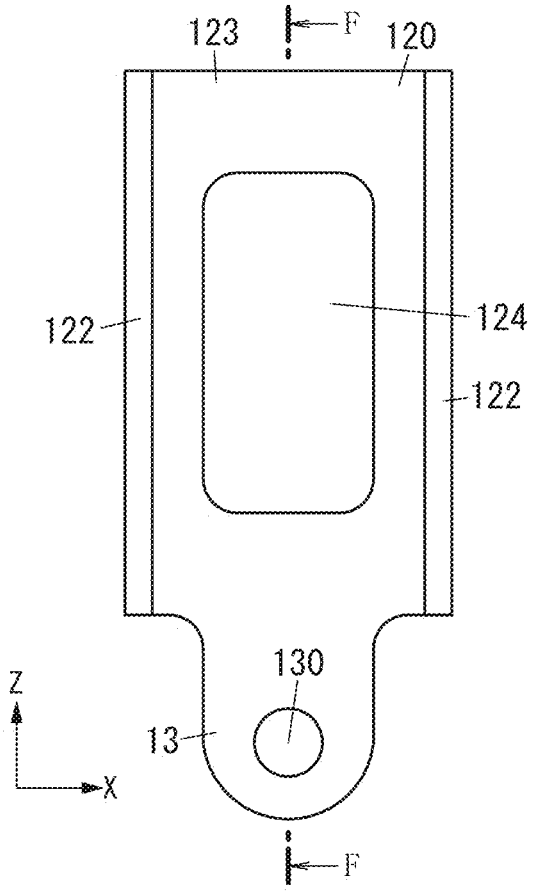
FIG. 6B is a side view of the mounting member.
Figure 6C:
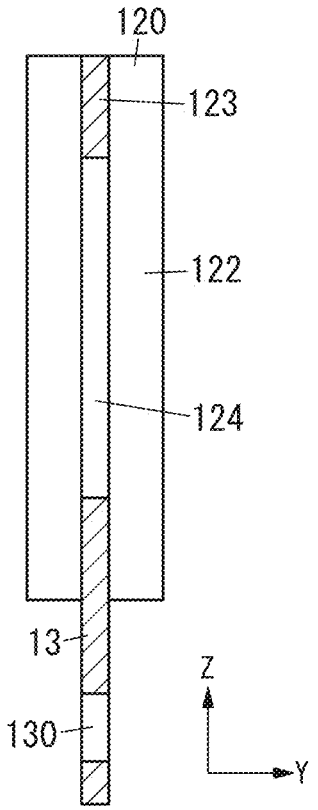
FIG. 6C is a cross-sectional view thereof taken along the plane F-F shown in FIG. 6B.

The lower fitting portion 12 includes a body 120 having an H shape in a plan view and a pair of front and rear elastic members 121 attached to the outer surfaces of the body 120. As shown in FIGS. 6A, 6B, and 6C, the body 120 includes a pair of front and rear flange parts 122, each having a rectangular plate shape, and a web part 123 also having a rectangular plate shape and located between the middle in the rightward/leftward direction of the front flange part 122 and the middle in the rightward/leftward direction of the rear flange part 122. The web part 123 has a rectangular hole 124 running through itself in the rightward/leftward direction. The hole 124 is provided in the central region in the upward/downward direction and forward/backward direction of the web part 123.

As shown in FIG. 5B, the front surface and right and left side surfaces of the front flange part 122 are covered, over the entire length thereof in the upward/downward direction, with the front elastic member 121. Likewise, the rear surface and right and left side surfaces of the rear flange part 122 are covered, over the entire length thereof in the upward/downward direction, with the rear elastic member 121.

As shown in FIGS. 6B and 6C, the lower coupling piece 13 is extended downward from the middle in the forward/backward direction of the lower surface of the web part 123 of the lower fitting portion 12. The lower coupling piece 13 has a flat plate shape. The dimension in the rightward/leftward direction (i.e., the thickness) of the lower coupling piece 13 is equal to the dimension in the rightward/leftward direction (i.e., the thickness) of the web part 123.

An upper part of the lower coupling piece 13 is provided to have a constant dimension in the forward/backward direction over the entire length thereof in the upward/downward direction, while a lower part of the lower coupling piece 13 is provided to have its dimension in the forward/backward direction decreased downward. In this embodiment, the lower surface of the lower coupling piece 13 is a downwardly convex arc surface. However, this is only an example and should not be construed as limiting. Alternatively, the lower surface of the lower coupling piece 13 may have any other shape as long as its dimension in the forward/backward direction decreases downward. The lower coupling piece 13 has a through hole 130 running through itself in the rightward/leftward direction. The through hole 130 is located closer to the bottom of the lower coupling piece 13.

The body 120 of the lower fitting portion 12 is a cast piece formed by casting a metal such as iron. However, the body 120 does not have to be formed by casting but may also be formed by any other method such as welding or pressing. Each of the front and rear elastic members 121 may be made of ethylene propylene diene rubber, for example. Note that each of the front and rear elastic members 121 does not have to be made of rubber but may also be made of any other material with elasticity.

Bringing the front and rear elastic members 121 into elastic contact with the inner peripheral surface of the spacer body 73 of the left side spacer 70 as shown in FIG. 5B allows the lower mounting member 10 to be connected to the side spacer 70 such that the lower mounting member 10 is slidable in the upward/downward direction with respect to the side spacer 70. The lower surface portion 53 closing a front part of the bottom opening of the side spacer 70 and the lower surface portion 63 closing a rear part of the bottom opening reduce the chances of the lower fitting portion 12 falling off from the side spacer 70.

In this embodiment, the pair of lower coupling members 11 have the same shape and same dimensions as shown in FIGS. 1 and 5A. Each of the pair of lower coupling members 11 includes a screw 110 and a pair of washers 111. The screw 110 includes a head 112 with a hole or groove(s) to be driven with a tool and a shaft 113 extended from the head 112. The outer dimension (diameter) of the head 112 is larger than the diameter of the shaft 113. In this embodiment, the screw 110 is a self-locking screw and may be a Nojilock®.

Each of the pair of lower coupling members 11 couples its associated lower coupling piece 13 rotatably with respect to its associated lower protrusion 91 by letting the shaft 113 of the screw 110 pass through one of the two washers 111, the lower coupling piece 13, the other washer 111, and the lower protrusion 91 in this order. In this embodiment, the self-locking function of the screw 110 keeps the lower coupling piece 13 and the lower protrusion 91 coupled together. Note that the screw 110 does not have to have the self-locking function by itself. Alternatively, a nut may be fastened onto the shaft 113 of the screw 110. Still alternatively, the through hole 910 of the lower protrusion 91 may be implemented as a screw hole. Yet alternatively, a nut may be fixed by welding, for example, onto the inner surface in the rightward/leftward direction of the lower protrusion 91.

Next, the upper mounting unit 3 will be described.

As shown in FIG. 1, the upper mounting unit 3 includes: an upper fixing plate 14 to be fixed onto the upper frame part 20; a pair of upper mounting members 15 connected inside respective upper end portions of the pair of right and left side spacers 70 such that the pair of upper mounting members 15 are slidable in the upward/downward direction; and a pair of upper coupling members 16 coupling the pair of upper mounting members 15 to the upper fixing plate 14. Each of the pair of upper coupling members 16 runs, in the rightward/leftward direction, through an associated one of the pair of upper mounting members 15 and the upper fixing plate 14 to couple the associated upper mounting member 15 rotatably with respect to the upper fixing plate 14.

The upper mounting unit 3 has the structure obtained by rotating the lower mounting unit 4 180 degrees on a vertical plane. That is to say, the upper fixing plate 14 has the same structure as the lower fixing plate 9, and includes a body 140 and a pair of right and left upper protrusions 141. Each of the pair of right and left upper protrusions 141 has a through hole. The body 140 will be secured with fastening members 142 such as anchoring bolts onto the upper frame part 20.

The pair of upper mounting members 15 has the same structure as the pair of lower mounting members 10, and each include an upper fitting portion 17 to be fitted into an upper end portion of the associated side spacer 70 and an upper coupling piece 18 extended upward from the upper fitting portion 17. The upper coupling piece 18 has a smaller dimension in the forward/backward direction than the upper fitting portion 17. An upper part of the upper coupling piece 18 is provided to have its dimension in the forward/backward direction decreased upward.

Bringing elastic members provided forward and backward of each upper fitting portion 17 into elastic contact with the inner peripheral surface of the spacer body 73 of the associated side spacer 70 allows the upper mounting member 15 to be connected to the side spacer 70 such that the upper mounting member 15 is slidable in the upward/downward direction with respect to the side spacer 70. The upper surface portion 52 closing a front part of the top opening of the side spacer 70 and the upper surface portion 62 closing a rear part of the opening reduces the chances of the upper fitting portion 17 falling off from the side spacer 70.

The pair of upper coupling members 16 has the same structure as the pair of lower coupling members 11, and each includes a screw and a pair of washers. The screw may have a self-locking function, for example.

Each of the pair of upper coupling members 16 couples its associated upper coupling piece 18 rotatably with respect to its associated upper protrusion 141 by letting the shaft of the screw pass through one of the two washers, the upper coupling piece 18, the other washer, and the upper protrusion 141 in this order. In this embodiment, the self-locking function of the screw keeps the upper coupling piece 18 and the upper protrusion 141 coupled together. Note that the screw does not have to have the self-locking function by itself. Alternatively, a nut may be fastened onto the shaft of the screw. Still alternatively, the through hole of the upper protrusion 141 may be configured as a screw hole.

The structure for mounting the panel 1 further includes a supporting member 19, arranged between the panel 1 and the lower fixing plate 9, for supporting the panel 1 such that the panel 1 is swingable. The panel 1 supported by the supporting member 19 is swingable such that the lower surface of the panel 1 leans, around the supported point, toward either a lower right corner or lower left corner.

The supporting member 19 may be configured as either a rectangular parallelepiped block of rubber or a square pipe of aluminum, for example. The supporting member 19 supports the panel 1 at a position upwardly spaced from the lower fixing plate 9 with an upper part of the supporting member 19 received in the recess 720 provided in the middle in the rightward/leftward direction of the lower spacer 72. The supporting member 19 is arranged so as to overlap in the upward/downward direction with the center of gravity of the panel 1.

Next, an exemplary method of installing the panel 1 will be described.

In the panel 1 for use in this example, the spacer 7 and the core member 8 have already been fixed between the plate members 5 and 6, and the pair of lower mounting members 10, the pair of upper mounting members 15, and the four cover members 79 have already been attached to the right and left side spacers 70. Each of the pair of lower mounting members 10 and pair of upper mounting members 15 has already been inserted deeper into its associated side spacer 70 along the length thereof.

First of all, the lower fixing plate 9 is secured with the plurality of fastening members 92 onto the lower frame part 21, and the upper fixing plate 14 is secured with the plurality of fastening members 142 onto the upper frame part 20. At this time, the lower and upper fixing plates 9 and 14 are secured so as to face each other in the upward/downward direction.

Next, the panel 1 is arranged between the lower fixing plate 9 and the upper fixing plate 14, and the respective upper coupling pieces 18 of the pair of upper mounting members 15 are pulled upward from the pair of right and left side spacers 70 of the panel 1 and then coupled one to one to the right and left upper protrusions 141 of the upper fixing plate 14 with the pair of upper coupling members 16.

Subsequently, the panel 1 is lifted upward to pull the respective lower coupling pieces 13 of the pair of lower mounting members 10 downward from the side spacers 70 of the panel 1. Then, the respective lower coupling pieces 13 are coupled one to one to the right and left lower protrusions 91 of the lower fixing plate 9 with the pair of lower coupling members 11.

Thereafter, the supporting member 19 is arranged at the middle in the rightward/leftward direction of the lower fixing plate 9, and the panel 1 is brought downward to be mounted on the supporting member 19 such that an upper part of the supporting member 19 is received in the middle in the rightward/leftward direction of the recess 720 in the lower spacer 72 of the panel 1.

Then, the gap between the lower frame part 21 and the panel 1 is filled with an elastically deformable sealant 24 having a rectangular frame shape in a plan view. In this embodiment, the gap is filled with the sealant 24 with such a rectangular frame shape in a plan view with one backup member 25 interposed between each of the lower right and left cover members 79 and the lower frame part 21. This allows the supporting member 19 and the lower mounting unit 4 to be completely covered with the sealant 24.

Meanwhile, the gap between the upper frame part 20 and the panel 1 is filled with an elastically deformable sealant 24 having a rectangular frame shape in a plan view. In this embodiment, the gap is filled with the sealant 24 with such a rectangular frame shape in a plan view with one backup member 25 interposed between each of the upper right and left cover members 79 and the upper frame part 20. This allows the upper mounting unit 3 to be completely covered with the sealant 24.

In the same procedure, a plurality of panels 1 may be arranged side by side in the rightward/leftward direction between the upper frame part 20 and lower frame part 21 of the building 2 (see FIG. 2).

In the structure for mounting the panel 1 according to this embodiment that has been installed in this manner, the pair of right and left upper mounting members 15 connected to the respective upper end portions of the panel 1 are coupled so as to be rotatable around the respective shafts of the upper coupling members 16, of which the axial direction is defined in the rightward/leftward direction, with respect to the upper fixing plate 14. In addition, in the structure for mounting the panel 1 according to this embodiment, the pair of right and left lower mounting members 10 connected to the respective lower end portions of the panel 1 are coupled so as to be rotatable around the respective shafts 113 of the lower coupling members 11, of which the axial direction is defined in the rightward/leftward direction, with respect to the lower fixing plate 9.

Thus, the structure for mounting the panel 1 according to this embodiment allows, when the panel 1 is bent in the wind, each of the pair of upper mounting members 15 and the pair of lower mounting members 10 to rotate and consequently tilt appropriately according to the degree of bending of the panel 1.

Therefore, the structure for mounting a panel 1 according to this embodiment reduces the chances of, when the panel 1 is bent in the wind, the pair of upper mounting members 15 and the pair of lower mounting members 10 being deformed under excessive load. This allows the structure for mounting the panel 1 according to this embodiment to ensure that the panel 1 is mounted with the pair of upper mounting members 15 and the pair of lower mounting members 10 at a sufficient mounting strength to the building 2 even when bent in the wind.

In addition, the pair of upper mounting members 15 and pair of lower mounting members 10 are slidable, when rotating and thus tilting appropriately according to the degree of bending of the panel 1, inside the side spacers 70 along the length thereof while making elastic contact with the inner peripheral surface of the side spacers 70. Thus, this reduces the chances of the pair of upper mounting members 15 and the pair of lower mounting members 10 receiving excessive load from the side spacers 70 and thereby being deformed when rotating and consequently tilting.

Furthermore, the structure for mounting the panel 1 according to this embodiment allows the pair of upper mounting members 15 to be coupled to the pair of upper protrusions 141 of the upper fixing plate 14 simply by inserting the upper coupling members 16 sideways with respect to the panel 1, thus facilitating the installation. The same statement applies to the lower coupling members 11 as well.

Besides, in the structure for mounting the panel 1 according to this embodiment, each of the pair of upper mounting members 15 includes the upper coupling piece 18 with a small dimension in the forward/backward direction and having an upper part, of which the dimension in the forward/backward direction decreases upward. This reduces the chances of, when the pair of upper mounting members 15 rotates, the upper coupling pieces 18 coming into contact with the upper frame part 20 to obstruct the rotation of the upper mounting members 15. The same statement applies to the lower mounting members 10 as well.

Moreover, the structure for mounting the panel 1 according to this embodiment allows the respective lower end portions of the pair of right and left upper protrusions 141 of the upper fixing plate 14 to be received in the respective upper end portions of the pair of right and left side spacers 70, and also allows the respective upper end portions of the pair of right and left lower protrusions 91 of the lower fixing plate 9 to be received in the respective lower end portions of the pair of right and left side spacers 70. Thus, the structure for mounting the panel 1 according to this embodiment prevents the pair of right and left upper protrusions 141 of the upper fixing plate 14 or the pair of right and left lower protrusions 91 of the lower fixing plate 9 from being deformed or damaged by coming into contact with the panel 1.

Furthermore, in the structure for mounting the panel 1 according to this embodiment, the panel 1 is mounted to be swingable with respect to the lower frame part 21 and the upper frame part 20. Thus, the structure for mounting the panel 1 according to this embodiment allows the panel 1 to swing, when an earthquake happens, for example, in such a manner as to follow the story displacement caused by the earthquake. This reduces the chances of the panel 1 dropping off or being broken down even in such a situation.

Variations

Next, variations of the structure for mounting the panel 1 according to this embodiment will be described.

Figure 7A:
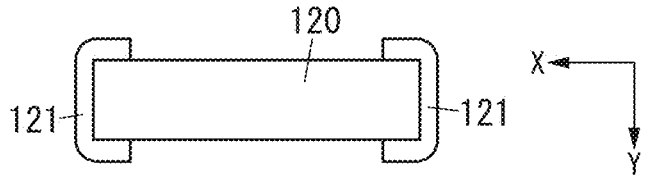
FIG. 7A is a plan view illustrating a variation of the mounting member.
Figure 7B:
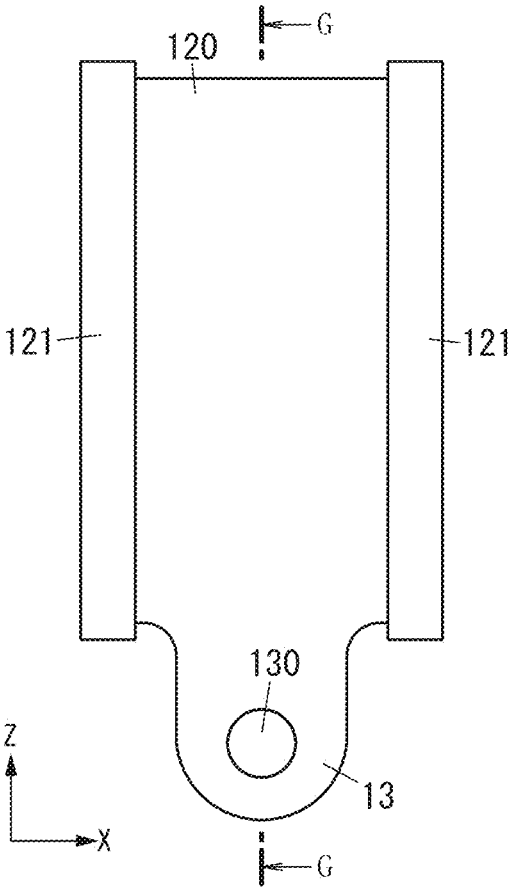
FIG. 7B is a side view of the mounting member.
Figure 7C:
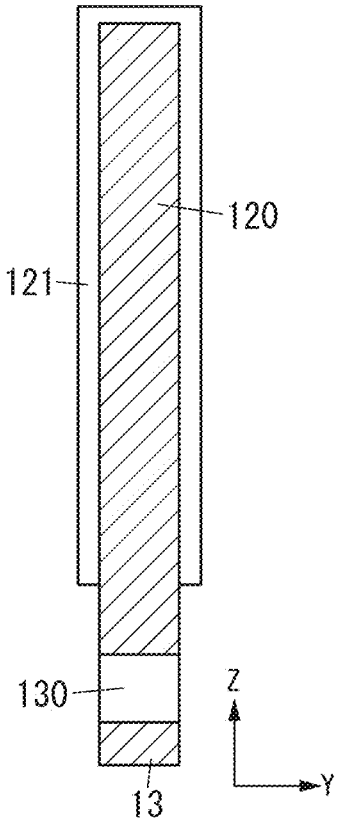
FIG. 7C is a cross-sectional view thereof taken along the plane G-G shown in FIG. 7B.

The pair of lower mounting members 10 do not have to have the H-shape in a plan view but may also have any other appropriate planar shape. For example, as in the variation shown in FIGS. 7A, 7B, and 7C, each of the pair of lower mounting members 10 may include a lower fitting portion 12 made up of a body 120 in a rectangular plate shape in a plan view and a pair of front and rear elastic members 121 attached to the body 120. The body 120 may be made of a metal such as iron or stainless steel. The same variation is applicable to the pair of upper mounting members 15 as well.

Optionally, in each of the pair of lower mounting members 10, the dimension in the forward/backward direction of the lower coupling piece 13 may be equal to that of the body 120 of the lower fitting portion 12. Likewise, in each of the pair of upper mounting members 15, the dimension in the forward/backward direction of the upper coupling piece 18 may be equal to that of the body of the upper fitting portion 17.

In each of the pair of lower mounting members 10, a lower part of the lower coupling piece 13 does not have to have its dimension in the forward/backward direction decreasing downward. Alternatively, the lower coupling piece 13 may also have a constant dimension in the forward/backward direction over the entire length thereof in the upward/downward direction. Likewise, in each of the pair of upper mounting members 15, an upper part of the upper coupling piece 18 does not have to have its dimension in the forward/backward direction decreasing upward. Alternatively, the upper coupling piece 18 may also have a constant dimension in the forward/backward direction over the entire length thereof in the upward/downward direction.

The lower end portion of each of the upper protrusions 141 of the upper fixing plate 14 does not have to be received in the upper end portion of associated one of the side spacers 70 but may be located over the side spacer 70. Likewise, the upper end portion of each of the lower protrusions 91 of the lower fixing plate 9 does not have to be received in the lower end portion of associated one of the side spacers 70 but may be located under the side spacer 70.

Figure 8A:
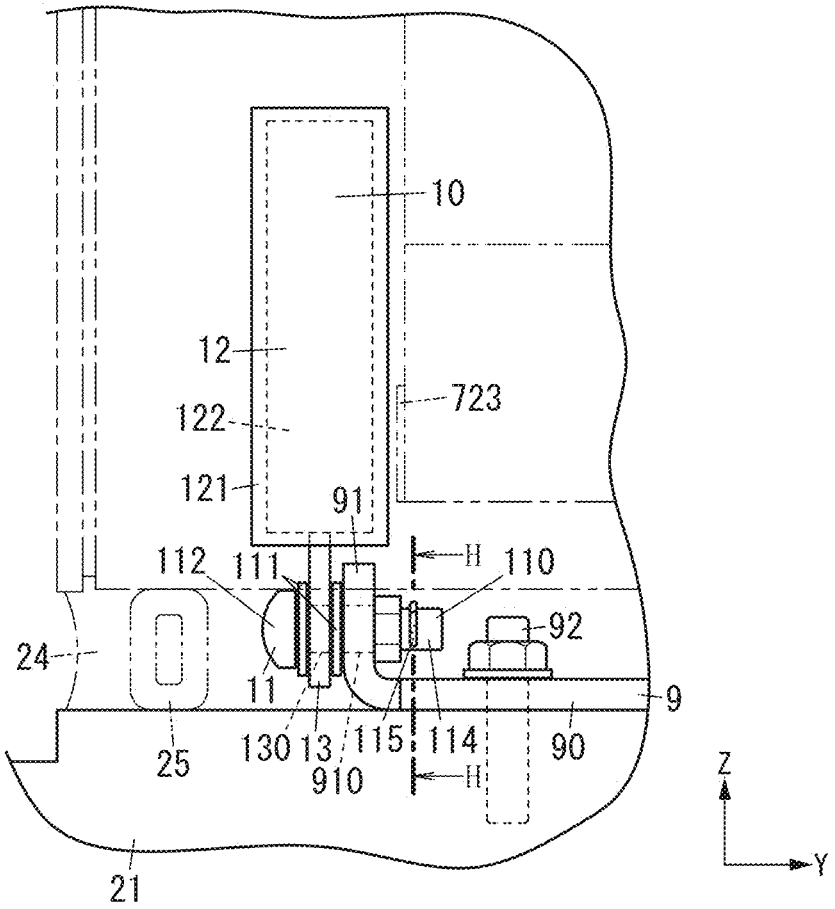
FIG. 8A illustrates a main part of a variation of the structure for mounting the louver panel.
Figure 8B:
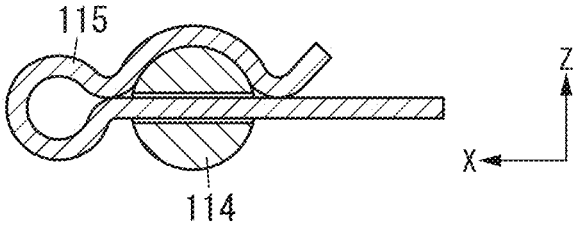
FIG. 8B is a cross-sectional view thereof taken along the plane H-H shown in FIG. 8A.
Figure 9:
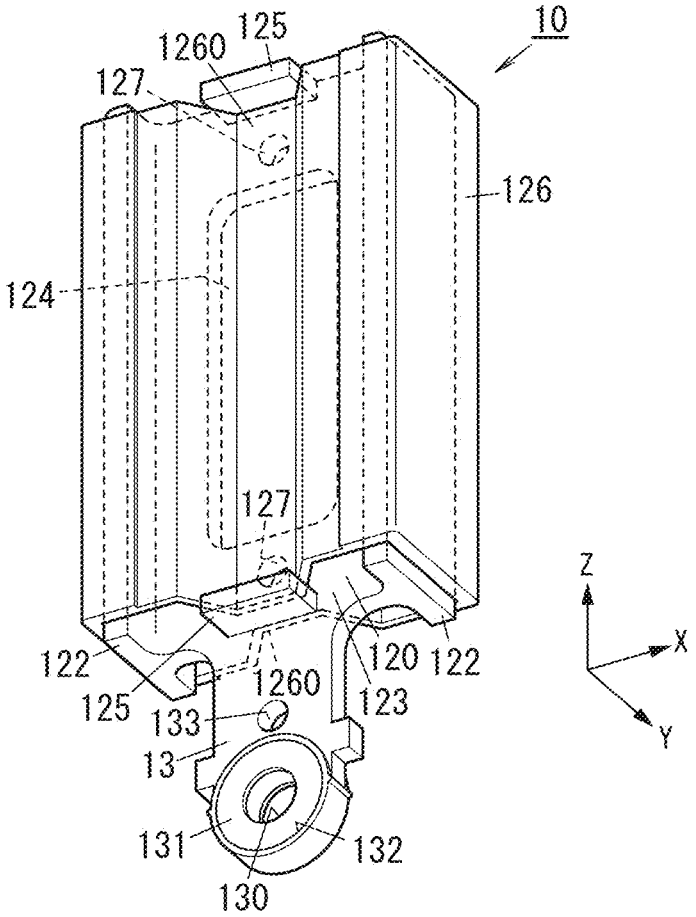
FIG. 9 is a perspective view illustrating a variation of the mounting member.
Figure 10A:
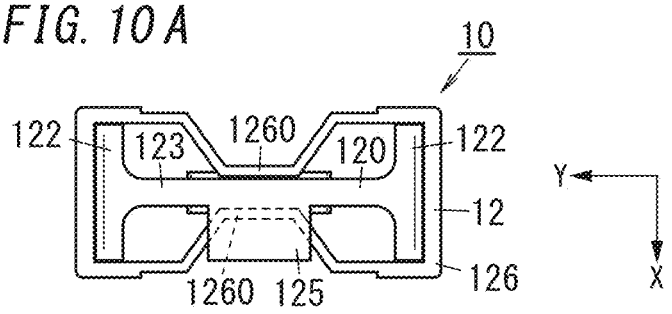
FIG. 10A is a plan view illustrating a variation of the mounting member.
Figure 10B:
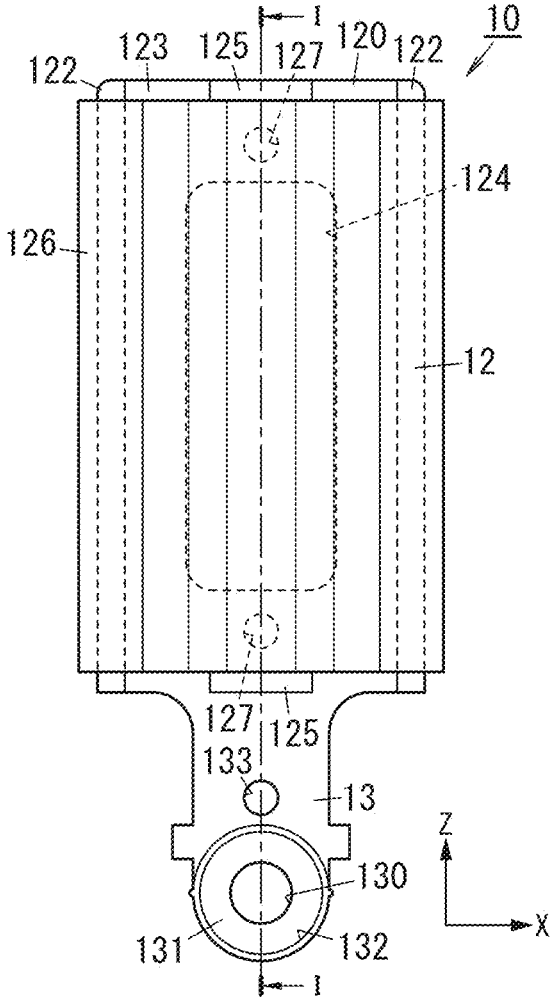
FIG. 10B is a side view of the mounting member.
Figure 10C:
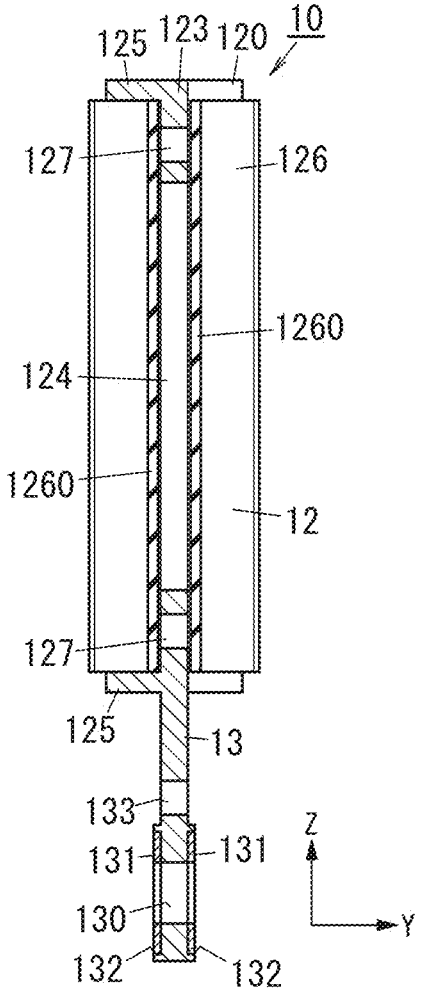
FIG. 10C is a cross-sectional view thereof taken along the plane I-I shown in FIG. 10B.

Optionally, one of the pair of lower coupling members 11 may include, instead of the screw 110, a pin 114 with no screw threads and a stopper snap pin 115 attached removably to the tip of the pin 114 as shown in FIGS. 8A and 8B. The same statement applies to the pair of upper coupling members 16 as well.

The cover body 741 of the decorative cover 74 does not have to have a rectangular plate shape. Alternatively, the cover body 741 may also be formed such that the outer surface in the rightward/leftward direction (i.e., a surface facing away from the spacer body 73) is a curved surface with a convex arced plane cross section. This reduces the chances of the cover body 741 emitting a wind noise when the panel 1 is used as an exterior louver. Still alternatively, the cover body 741 may also have any other appropriate shape, instead of the rectangular plate shape or the curved surface shape.

Optionally, the lower spacer 72 and the side spacers 70 may be arranged directly in contact with each other with no closing plates 723 or sealant 724 interposed. Likewise, the upper spacer 71 and the side spacers 70 may also be arranged directly in contact with each other without no closing plates 713 or sealant 714 interposed.

The upper spacer 71 may be a straight tube with a rectangular cross section having no recesses 710.

Optionally, in each of the pair of lower mounting members 10, the lower fitting portion 12 thereof may be made up of a body 120 further including a pair of supporting portions 125 and a cylindrical elastic member 126 attached to the body 120 as in the variation illustrated in FIGS. 9, 10A, 10B, and 10C. In addition, the lower coupling piece 13 may include two recesses 132 located around the through hole 130 on the right and left sides thereof, washers 131 arranged in the two recesses 132, and another hole 133 located over the through hole 130.

The pair of supporting portions 125 protrudes leftward from the upper and lower ends of the web part 123. Each of the pair of supporting portions 125 has a rectangular plate shape. The web part 123 further has two circular holes 127 running through itself in the rightward/leftward direction. One of the two holes 127 is cut through the web part 123 between the upper supporting portion 125 and the hole 124. The other hole 127 is cut through the web part 123 between the hole 124 and the lower supporting portion 125.

The elastic member 126 has a square tubular shape, and has an inwardly recessed mounting portion 1260 on a part of its circumference. In this embodiment, the elastic member 126 includes a pair of right and left mounting portions 1260.

The elastic member 126 is attached to the body 120 such that one part thereof is in contact with the front surface and right and left side surfaces of the front flange part 122, another part thereof is in contact with the rear surface and right and left side surfaces of the rear flange part 122, and one of the pair of right and left mounting portions 1260 is located between the upper and lower supporting portions 125. The upper and lower supporting portions 125 reduce the chances of the elastic member 126 falling off from the body 120.

The elastic member 126 and the washers 131 may be made of ethylene propylene diene rubber or chloroprene rubber, for example. However, this is only an example and should not be construed as limiting. The elastic member 126 and the washers 131 may also be made of any other material with elasticity. Providing the washers 131 with elasticity around the through hole 130 reduces the backlash of the pin 114 inserted. The same variation is also applicable to each of the pair of upper mounting members 15.

Figure 11:
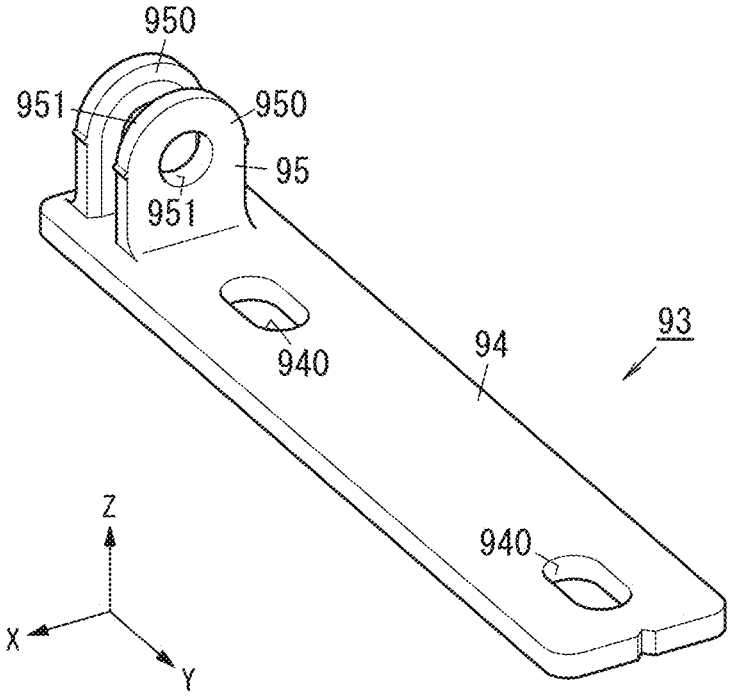
FIG. 11 is a perspective view illustrating a variation of a fixing plate for the structure for mounting the louver panel.

The lower fixing plate 9 does not have to be made of a single member but may also be made up of two members arranged side by side in the rightward/leftward direction. FIG. 11 illustrates one of the two members that form the lower fixing plate 9. These two members have the same structure.

The fixing plate 93 shown in FIG. 11 includes a body 94 in a rectangular plate shape, and a protruding portion 95 extended upward from one end in the rightward/leftward direction of the body 94. The body 94 has insertion holes 940, to each of which a fastening member 92 such as an anchoring bolt is inserted. The body 94 will be secured with the fastening members 92 onto the lower frame part 21.

The protruding portion 95 is made up of a pair of protruding pieces 950. The pair of protruding pieces 950 are arranged parallel to each other to be spaced from each other in the rightward/leftward direction. Each of the pair of protruding pieces 950 has a semi-elliptical plate shape in a side view. Each of the pair of protruding pieces 950 has a through hole running through itself in the rightward/leftward direction. In this variation, the pair of right and left lower protrusions 91 of the lower fixing plate 9 is configured as two protruding portions 95 (i.e., four protruding pieces 950) of the two fixing plates 93 arranged side by side in the rightward/leftward direction. The fixing plate 93 may be a cast piece made of a metal such as iron.

Between the pair of protruding pieces 950, arranged is the lower coupling piece 13 of associated one of the lower mounting members 10. The lower coupling member 11 couples the pair of protruding pieces 950 and the lower coupling piece 13 together. In this case, when the lower mounting member 10 of the variation shown in FIG. 9 and other drawings is used as the lower mounting member 10, the gaps between the pair of protruding pieces 950 and the lower coupling piece 13 may be filled with the washers 131 with elasticity. The same variation is applicable to the upper fixing plate 14. That is to say, the upper fixing plate 14 may also be made up of two fixing plates 93. Optionally, the fixing plate 9, 14 may even be made up of four fixing plates 93.

Advantages

As can be seen from the foregoing description of a structure for mounting a panel 1 according to the first exemplary embodiment and its variations described above, a structure for mounting a panel (1) according to a first aspect of the present invention has the following first feature:

Specifically, a structure for mounting a panel (1) according to the first aspect includes: panel (1) designed to be installed between an upper frame part (20) and a lower frame part (21) of a building (2); an upper mounting unit (3) configured to mount an upper end portion of the panel (1) onto the upper frame part (20); and a lower mounting unit (4) configured to mount a lower end portion of the panel (1) onto the lower frame part (21).

The panel (1) includes: a pair of plate members (5, 6) arranged to face each other in a forward/backward direction; a spacer (7) having a shape of a rectangular frame and arranged between the pair of plate members (5, 6); and a core member (8) arranged in a region, surrounded with the spacer (7), between the pair of plate members (5, 6). The spacer (7) includes right and left frame parts. The right and left frame parts are configured as a pair of right and left side spacers (70) formed in a straight tubular shape.

The upper mounting unit (3) includes: an upper fixing plate (14) to be fixed onto the upper frame part (20); a pair of upper mounting members (15) connected inside respective upper end portions of the pair of right and left side spacers (70) such that the pair of upper mounting members (15) are slidable in an upward/downward direction; and a pair of upper coupling members (16) coupling the pair of upper mounting members (15) to the upper fixing plate (14).

The lower mounting unit (4) includes: a lower fixing plate (9) to be fixed onto the lower frame part (21); a pair of lower mounting members (10) connected inside respective lower end portions of the pair of right and left side spacers (70) such that the pair of lower mounting members (10) are slidable in the upward/downward direction; and a pair of lower coupling members (11) coupling the pair of lower mounting members (10) to the lower fixing plate (9).

Each of the pair of upper coupling members (16) runs, in a rightward/leftward direction, through an associated one of the pair of upper mounting members (15) and the upper fixing plate (14) to couple the associated upper mounting member (15) rotatably with respect to the upper fixing plate (14).

Each of the pair of lower coupling members (11) runs, in the rightward/leftward direction, through an associated one of the pair of lower mounting members (10) and the lower fixing plate (9) to couple the associated lower mounting member (10) rotatably with respect to the lower fixing plate (9).

The structure for mounting a panel (1) according to the first aspect, having this first feature, allows, when the panel (1) is bent in the wind, each of the pair of upper mounting members (15) to rotate and consequently tilt around its associated upper coupling member (16) according to the degree of bending of the panel (1). In addition, in such a situation, each of the pair of lower mounting members (10) is also allowed to rotate and consequently tilt around its associated lower coupling member (11) according to the degree of bending of the panel (1).

Thus, the structure for mounting a panel (1) according to the first aspect reduces the chances of, when the panel (1) is bent in the wind, the pair of upper mounting members (15) and the pair of lower mounting members (10) being deformed under excessive load. This allows the structure for mounting the panel (1) according to the first aspect to ensure that the panel (1) is mounted with the pair of upper mounting members (15) and the pair of lower mounting members (10) at a sufficient mounting strength to the building (2) even when bent in the wind.

In addition, as can be seen from the foregoing description of a structure for mounting a panel 1 according to the first exemplary embodiment described above, a structure for mounting a panel (1) according to a second aspect of the present invention has the following second feature as well as the first feature described above:

Specifically, in the structure for mounting the panel (1) according to the second aspect, each of the pair of upper mounting members (15) includes: an upper fitting portion (17) fitted into an upper end portion of an associated one of the pair of right and left side spacers (70); and an upper coupling piece (18) extended upward from the upper fitting portion (17) and allowing an associated one of the pair of upper coupling members (16) to run through the upper coupling piece (18).

Each of the pair of lower mounting members (10) includes: a lower fitting portion (12) fitted into a lower end portion of an associated one of the pair of right and left side spacers (70); and a lower coupling piece (13) extended downward from the lower fitting portion (12) and allowing an associated one of the pair of lower coupling members (11) to run through the lower coupling piece (13).

The upper coupling piece (18) has a smaller dimension in the forward/backward direction than the upper fitting portion (17). The lower coupling piece (13) has a smaller dimension in the forward/backward direction than the lower fitting portion (12).

The structure for mounting the panel (1) according to the second aspect, having this second feature, reduces the chances of, when each of the pair of upper mounting members (15) rotates and consequently tilts around the associated upper coupling member (16) according to the degree of bending of the panel (1), the upper coupling piece (18) coming into contact with the upper frame part (20) to obstruct the rotation of the upper mounting member (15). In addition, this also reduces the chances of, when each of the pair of lower mounting members (10) rotates and consequently tilts around the associated lower coupling member (11) according to the degree of bending of the panel (1), the lower coupling piece (13) coming into contact with the lower frame part (21) to obstruct the rotation of the lower mounting member (10).

In addition, as can be seen from the foregoing description of a structure for mounting a panel 1 according to the first exemplary embodiment described above, a structure for mounting a panel (1) according to a third aspect of the present invention has the following third feature as well as the first and second features described above:

Specifically, in the structure for mounting the panel (1) according to the third aspect, an upper part of the upper coupling piece (18) is formed such that a dimension in the forward/backward direction of the upper part decreases toward a top of the upper part, and a lower part of the lower coupling piece (13) is formed such that a dimension in the forward/backward direction of the lower part decreases toward a bottom of the lower part.

The structure for mounting the panel (1) according to the third aspect, having this third feature, further reduces the chances of, when each of the pair of upper mounting members (15) rotates and consequently tilts around the associated upper coupling member (16) according to the degree of bending of the panel (1), the upper surface of the upper coupling piece (18) coming into contact with the upper frame part (20). In addition, this further reduces the chances of, when each of the pair of lower mounting members (10) rotates and consequently tilts around the associated lower coupling member (11) according to the degree of bending of the panel (1), the lower surface of the lower coupling piece (13) coming into contact with the lower frame part (21).

In addition, as can be seen from the foregoing description of a structure for mounting a panel 1 according to the first exemplary embodiment described above, a structure for mounting a panel (1) according to a fourth aspect of the present invention has the following fourth feature in conjunction with the structure for mounting the panel (1) according to any one of the first to fourth aspects:

Specifically, in the structure for mounting the panel (1) according to the fourth aspect, the upper fixing plate (14) has a pair of right and left upper protrusions (141). Each of the pair of right and left upper protrusions (141) protrudes downward and allows an associated one of the pair of upper coupling members (16) to run through the upper protrusion (141). The lower fixing plate (9) has a pair of right and left lower protrusions (91). Each of the pair of right and left lower protrusions (91) protrudes upward and allows an associated one of the pair of lower coupling members (11) to run through the lower protrusion (91).

Respective lower end portions of the pair of right and left upper protrusions (141) are received in respective upper end portions of the pair of right and left side spacers (70). Respective upper end portions of the pair of right and left lower protrusions (91) are received in respective lower end portions of the pair of right and left side spacers (70).

The structure for mounting the panel (1) according to the fourth aspect, having this fourth feature, prevents the upper protrusions (141) or lower protrusions (91) from being deformed or damaged by coming into contact with the panel (1).

Note that embodiments described above with reference to the accompanying drawings are only examples of the present invention and should not be construed as limiting. Rather, those embodiments may be readily modified in various manners, depending on a design choice or any other factor, without departing from a scope of the present invention.

REFERENCE SIGNS LIST

1 Louver Panel
2 Building
20 Upper Frame Part
21 Lower Frame Part
3 Upper Mounting Unit
4 Lower Mounting Unit
5 Plate Member
6 Plate Member
7 Spacer
70 Side Spacer
8 Core Member
9 Lower Fixing Plate
91 Lower Protrusion
10 Lower Mounting Member
11 Lower Coupling Member
12 Lower Fitting Portion
13 Lower Coupling Piece
14 Upper Fixing Plate
141 Upper Protrusion
15 Upper Mounting Member
16 Upper Coupling Member
17 Upper Fitting Portion
18 Upper Coupling Piece

The invention claimed is:

1. A structure for mounting a louver panel, the louver panel being designed to be installed between an upper frame part and a lower frame part of a building, the structure comprising:

the louver panel;

an upper mounting unit configured to mount an upper end portion of the louver panel onto the upper frame part; and a lower mounting unit configured to mount a lower end portion of the louver panel onto the lower frame part, the louver panel including:

a pair of plate members arranged to face each other in a forward/backward direction;

a spacer having a shape of a rectangular frame and arranged between the pair of plate members; and a core member arranged in a region between the pair of plate members, the region being surrounded with the spacer, the spacer including right and left frame parts, the right and left frame parts being configured as a pair of right and left side spacers formed in a straight tubular shape, the upper mounting unit including:

an upper fixing plate to be fixed onto the upper frame part;

a pair of upper mounting members connected inside respective upper end portions of the pair of right and left side spacers such that the pair of upper mounting members are slidable in an upward/downward direction; and a pair of upper coupling members coupling the pair of upper mounting members to the upper fixing plate, the lower mounting unit including:

a lower fixing plate to be fixed onto the lower frame part;

a pair of lower mounting members connected inside respective lower end portions of the pair of right and left side spacers such that the pair of lower mounting members are slidable in the upward/downward direction; and a pair of lower coupling members coupling the pair of lower mounting members to the lower fixing plate, each of the pair of upper coupling members running, in a rightward/leftward direction, through an associated one of the pair of upper mounting members and the upper fixing plate to couple the associated upper mounting member rotatably with respect to the upper fixing plate, each of the pair of lower coupling members running, in the rightward/leftward direction, through an associated one of the pair of lower mounting members and the lower fixing plate to couple the associated lower mounting member rotatably with respect to the lower fixing plate.

2. The structure of claim 1, wherein each of the pair of upper mounting members includes: an upper fitting portion fitted into an upper end portion of an associated one of the pair of right and left side spacers; and an upper coupling piece extended upward from the upper fitting portion and allowing an associated one of the pair of upper coupling members to run through the upper coupling piece, each of the pair of lower mounting members includes: a lower fitting portion fitted into a lower end portion of an associated one of the pair of right and left side spacers; and a lower coupling piece extended downward from the lower fitting portion and allowing an associated one of the pair of lower coupling members to run through the lower coupling piece, the upper coupling piece has a smaller dimension in the forward/backward direction than the upper fitting portion, and the lower coupling piece has a smaller dimension in the forward/backward direction than the lower fitting portion.

3. The structure of claim 2, wherein an upper part of the upper coupling piece is formed such that a dimension in the forward/backward direction of the upper part decreases toward a top of the upper part, and a lower part of the lower coupling piece is formed such that a dimension in the forward/backward direction of the lower part decreases toward a bottom of the lower part.

4. The structure of claim 1, wherein the upper fixing plate has a pair of right and left upper protrusions, each of the pair of right and left upper protrusions protruding downward and allowing an associated one of the pair of upper coupling members to run through one of the right and left upper protrusions, the lower fixing plate has a pair of right and left lower protrusions, each of the pair of right and left lower protrusions protruding upward and allowing an associated one of the pair of lower coupling members to run through one of the right and left lower protrusions, respective lower end portions of the pair of right and left upper protrusions are received in respective upper end portions of the pair of right and left side spacers, and respective upper end portions of the pair of right and left lower protrusions are received in respective lower end portions of the pair of right and left side spacers.

5. The structure of claim 2, wherein the upper fixing plate has a pair of right and left upper protrusions, each of the pair of right and left upper protrusions protruding downward and allowing an associated one of the pair of upper coupling members to run through one of the right and left upper protrusions, the lower fixing plate has a pair of right and left lower protrusions, each of the pair of right and left lower protrusions protruding upward and allowing an associated one of the pair of lower coupling members to run through one of the right and left lower protrusions, respective lower end portions of the pair of right and left upper protrusions are received in respective upper end portions of the pair of right and left side spacers, and respective upper end portions of the pair of right and left lower protrusions are received in respective lower end portions of the pair of right and left side spacers.

6. The structure of claim 3, wherein the upper fixing plate has a pair of right and left upper protrusions, each of the pair of right and left upper protrusions protruding downward and allowing an associated one of the pair of upper coupling members to run through one of the right and left upper protrusions, the lower fixing plate has a pair of right and left lower protrusions, each of the pair of right and left lower protrusions protruding upward and allowing an associated one of the pair of lower coupling members to run through one of the right and left lower protrusions, respective lower end portions of the pair of right and left upper protrusions are received in respective upper end portions of the pair of right and left side spacers, and respective upper end portions of the pair of right and left lower protrusions are received in respective lower end portions of the pair of right and left side spacers.

* * * * *